United States Patent [19]

Avidan

[11] Patent Number: 4,926,766

[45] Date of Patent: May 22, 1990

[54] CIRCULATING FLUID BED COMBUSTION WITH CIRCULATING CO COMBUSTION PROMOTER

[75] Inventor: Amos A. Avidan, Yardley, Pa.

[73] Assignee: Mobil Oil Corporation, New York, N.Y.

[21] Appl. No.: 270,930

[22] Filed: Nov. 14, 1988

[51] Int. Cl.[5] ..... F23B 7/00

[52] U.S. Cl. ..... 110/342; 110/345; 110/347; 431/7

[58] Field of Search ..... 431/3, 4, 7; 110/342, 110/344, 345, 346

[56] References Cited

U.S. PATENT DOCUMENTS

| | | | |
|---|---|---|---|
| 4,388,877 | 6/1983 | Molayem et al. | 110/342 |
| 4,515,092 | 5/1985 | Walsh et al. | 110/342 X |
| 4,579,070 | 4/1986 | Lin et al. | 110/345 |
| 4,735,705 | 4/1988 | Burk, Jr. et al. | 110/345 |

*Primary Examiner*—Edward G. Favors

*Attorney, Agent, or Firm*—A. J. McKillop; C. J. Speciale; R. D. Stone

[57] ABSTRACT

Addition of a readily fluidizable, 100–400 micron average diameter particular CO combustion promoter to a circulating fluid bed (CFB) combustion unit improves the efficiency of CO burning, reduces emissions of CO and improves the efficiency of the unit.

16 Claims, 3 Drawing Sheets

CIRCULATING FLUID BED COMBUSTION WITH CIRCULATING CO COMBUSTION PROMOTER

FIELD OF THE INVENTION

This invention relates to circulating fluid bed combustors.

BACKGROUND

Fluidized bed combustion is a mature technology. Many fluidized bed processes where combustion occurs are known, including the regenerators associated with fluidized catalytic cracking (FCC) units, fluidized coal combustors, and "regenerators" associated with fluid cokers.

Many fluidized bed combustion processes achieve only partial combustion of carbon (in coke, hydrocarbon or coal) to $CO_2$. Partial combustion, to CO, represents a loss of energy and a source of air pollution.

In FCC regenerators, it is known to add a CO combustion promoter, such as PT, to the circulating catalyst inventory. Adding 0.1–10, usually 0.5–2 wt ppm Pt is common in FCC processes to achieve complete CO combustion. The Pt makes the regenerator run hotter, because of the more complete CO combustion. More air is added per unit weight of carbon burned, because more $CO_2$ is formed at the expense of CO. Although CO emissions are much reduced, there is an increase in $NO_X$ emissions, probably because of the more oxidizing atmosphere.

The Pt promoter lasts a long time in commercial FCC units, having an activity or catalyst life similar to that of the conventional FCC catalyst, which remains in the unit for months.

Similar results are noted in the Thermofor Catalytic Cracking (TCC) Process which is a moving bed analog to the FCC process.

Both FCC and TCC processes involve fairly clean feeds (heavy hydrocarbons) and stable, long lasting catalysts which are an ideal support for CO combustion promoters such as Pt.

Use of CO combustion promoters has been recommended for fluidized bed coke combustion. In U.S. Pat. No. 4,515,092 (Walsh et al), which is incorporated herein by reference, and in a related publication by Walsh et al entitled "A Laboratory Study of Petroleum Coke Combustion: Kinetics and Catalytic Effects", addition of sand-containing 0.1 and 1.0 wt. % Pt, is reported to promote CO combustion in a single fluidized bed of coke operating at 505° C.

A recent development has been the commercialization of circulating fluid bed (CFB) boilers.

In CFB units, operation is complex. A fuel, usually a low grade fuel with a lot of sulfur and other contaminants, e.g. coal, is burned in a riser combustor. The flow regime is primarily that of a fast fluidized bed, i.e., there are no large "bubbles". Motive force for the fast fluidized bed is usually combustion air added at the base of the riser. There is usually an extremely large range of particle sizes in CFB units.

Combustion air is generally added to the base of the fast fluidized bed, and the resulting flue gas is discharged from the top of the fast fluidized bed, generally into a cyclone separator which covers most of the larger particles, typically 100 microns plus, while allowing finer materials (fly ash) to be discharged with the flue gas. Solids recovered by the cyclone are recycled into the fast fluidized bed.

Heat is removed from the CFB units in many places. CFB units take advantage of the extremely high heat transfer rates which are obtainable in fluidized beds, and provide for one or more areas of heat recovery from the fluidized bed. Most units have at least one relatively dense phase fluidized bed heat exchanger intermediate the cyclone separator solids discharge and the fast fluidized bed combustor.

Fluid flow in CFBs is complex because of the tremendous range in particle size of materials which must be handled by many CFBs. When coal is the feed to a CFB unit, the particle size distribution can range from submicron particles to particles of several inches in diameter.

Submicron to several micron particles present include fly ash, ground dolomite or limestone, and perhaps a few particles of ground coal.

Particles less than 100 microns in diameter usually have a short life in CFB units, because the low efficiency cyclones usually associated with such units must be able to let the fly ash out, while retaining essentially all of the 100+micron material, which usually represents coal, or ground sulfur absorbing material such as dolomite.

The 100 micron-400 micron material in a CFB represents much of the circulating particulate inventory. Usually this material is the dolomite, limestone, and similar materials used as an $SO_X$ acceptor, and some portion of the low grade fuels such as coal. When clean, or at least low sulfur, fuels such as wood chips are burned the sulfur acceptor is not needed and sand, or some other inert is provided for fluidization.

The coal particles may range in size from several inches when first added to the fast fluidized bed to theoretically submicron particles produced by explosion or disintegration of large size particles of coal. The majority of the coal is in large particles, typically 300–1000 microns, which tend to remain in a lower portion of the CFB, by elutriation.

Many CFB units are designed to handle small amounts of agglomerated ash. At the temperatures at which CFBs operate (usually 1550°–1650° F.) there is much sintering of ash, which forms larger and larger particles. Many CFBs are designed to allow large ash agglomerates, typically in the order of 1000–2000 microns, to drop out of the bottom of the CFB unit, or be removed intermittantly.

The chemical reactions occurring during CFB operation are complex. Coke combustion, reactions of sulfur and nitrogen compounds with adsorbents, reactions of $NO_X$ with reducing gases (such as CO which may be present), etc., are representative reactions.

Despite the explosive growth in CFB technology (from no commercial units in 1978 to about 100 commercial units operating or under construction in 1988) I realized that the technology had some shortcomings. Particularly troublesome was the tendency of the units to all operate at the same exceedingly high temperature, which causes some metallurgical, operational and pollution problems. CFBs also operate with far more air than is required by stoichiometry.

Typical circulating fluidized bed designs are disclosed in U.S. Pat. No. 4,776,288 and U.S. Pat. No. 4,688,521, which are incorporated by reference.

Circulating fluid bed combustion systems operating with staged air injection, or staged firing, as disclosed in U.S. Pat. No. 4,462,341 or in a reducing mode circulating fluid bed combustion unit, such as disclosed in U.S. Pat. No. 4,579,070 will minimize somewhat $NO_X$ emissions. The contents of both of these patents are incorporated herein by reference.

Separation means used to remove recirculating solids from flue gas may comprise cyclones, or the gas and particle separation means disclosed in U.S. Pat. No. 4,442,797 which is incorporated herein by reference.

I reviewed the state of the art in circulating fluidized bed technology. Fortunately most of the work on circulating fluidized beds has been published in two volumes. The first was Circulating Fluidized Bed Technology, Proceedings of the First International Conference on Circulating Fluidized Beds, Halifax, Nova Scotia, Canada, Nov. 18–20, 1985, edited by Prabir Basu, Pergamon Press (hereafter CFB I) and, more recently, by Circulating Fluidized Bed Technology II, Proceedings of the Second International Conference on Circulating Fluidized Beds, Compiegne, France, 14–18 Mar. 1988, edited by Prabir Basu and Jean Francois Large, Pergamon Press (hereafter CFB II).

Other workers were aware of the problems remaining in use of CFB units, see e.g. Analysis of Circulating Fluidized Bed Combustion Technology and Scope For Future Development, Takehiko Furusawa and Tadaaki Shimizu, page 51, in CFB II. The authors focused on three areas.

1. Heat Recovery
2. Design of Cyclones and Carbon Burn-Up
3. $NO_X$ Emissions

I realized that the problems of better carbon burning, and reduced $NO_X/SO_X$ emissions were related. This relationship can best be understood by reviewing the problem of emissions from CFB boilers.

EMISSIONS FROM CFB BOILERS

CFB boilers are being commercialized rapidly due to many factors. The first is fuel flexibility—CFB boilers can handle a mixture of fuels, including those rich in ash and moisture and fuels which are difficult to burn in conventional boilers. Some fuels combusted in commercial CFB boilers include: coals, wood waste, bark, petroleum coke, oil and gas, lignite, brown coal, peat, coal washings' rejects and industrial and sewage sludges. High combustion efficiencies, often 99%, are achieved. Fuel handling and feeding is simple, heat release rates are high, turndown and load following is excellent and CFBs have demonstrated excellent commercial availability records.

Most importantly, it is in low emission levels where CFB boilers have excelled. Low particulate, $SO_X$ and $NO_X$ emissions have allowed new CFB boilers to be installed in areas where permitting of conventional boilers to handle low grade fuels would have been impossible. Some of these areas include Southern Calif., Japan and Europe. With increasing concern over air quality, acid rain and smog, CFB boilers offer an excellent alternative to utilities and industrial users. Their rate of commercialization is expected to continue at the fast rate of the past eight years.

The good contact between gas and solids in a CFB combustion affords excellent sulfur capture by circulating fine limestone. Ca/S ratios of 1–4 are used, and the resulting gypsum can be disposed of safely. Sulfur capture efficiencies of over 90% are possible. With combustion temperatures of 1550°–1650° F., and staged combustion (typically half of the air is introduced as secondary air), $NO_X$ emissions can be kept down to the 50–300 ppm range. $NO_X$ emissions decrease as excess $O_2$ in the flue gas is decreased. This is shown in FIG. 2, taken from FIG. 5 (N. Berge, $NO_X$ Control in a Circulating Fluidized Bed Combustor, CFB II, p. 426).

| | Typical Operating Conditions | |
|---|---|---|
| | Fixed ("bubbling") Fluid Bed Combustor | Circulating Fluid Bed Combustor |
| Temp, °F. | 1550 | 1650 |
| Pressure, psig | 2 | 3 |
| Superficial Velocity, ft/s | 3–12 | 15–25 |
| Entrainment lb/lb gms | 0.4–1 | 10–20 |
| gas residence time, sec | 0.5–1 | 3–4 |

Excess $O_2$ cannot be reduced below 2%, as at 1.5%, a sharp increase in CO occurs. This constraint is shown in FIG. 3, taken from FIG. 7 of the N. Berge publication.

Decreasing oxygen concentrations would decrease $NO_X$, but increase CO emissions. The best the unit could do would be to operate with enough air to achieve complete afterburning (20+% excess air!) and live with the $NO_X$ emissions.

I realized that it was possible to operate existing CFBs much more stably and efficiently, while producing less emissions and/or achieve higher throughputs.

I discovered a way to bring about a profound change in the operation of CFB units.

BRIEF SUMMARY OF THE INVENTION

Accordingly, the present invention provides in a circulating fluidized bed combustion zone wherein a carbon-containing material is burned by contact with an oxygen-containing gas in a generally vertical combustor comprising a fast fluidized bed of particulates wherein at least a majority of the particulate matter in the fast fluidized bed has a particle diameter in excess of 100 microns, to generate a flue gas/particulate stream which is discharged from the top of the combustor, said flue gas comprising flue gas, fines having a particle diameter less than about 100 microns, and circulating particles having an average particle size of about 100–400 microns, which flue gas passes through a separation means to recover from the flue gas at least a majority of the 100–400 micron particles which are recycled to the circulating fluidized bed combustion zone, the improvement comprising adding to the circulating particles a circulating CO combustion promoter in an amount equal to 0.001 to 100 wt. ppm of a promoter selected from the group of Pt, Pd, Ir, Rh, Os and compounds and mixtures thereof.

In a more limited embodiment the present invention provides in a circulating fluidized bed combustion process wherein a carbonaceous material containing sulfur and nitrogen impurities is burned by contact with air in a generally vertical combustor comprising a fast fluidized bed of particulates, wherein at least a majority of the particulate matter in the fast fluidized bed has a particle diameter in excess of 100 microns, and at least 25 wt. % of the particulate matter in said bed comprises a sulfur accepting material, and wherein combustion of the carbonaceous material occurs in a lower portion of said fast fluidized bed to produce a dilute phase fluidized bed stream comprising carbon monoxide, carbon dioxide, $SO_X$ and $NO_X$ and particulates in excess of 100 microns in diameter comprising sulfur acceptor, and fines generated in said fast fluidized bed, wherein said dilute phase stream is passed to a separation means which recovers essentially all of the particulates in excess of 100 microns equivalent diameter and which discharges a majority of the fines with a flue gas stream, and said recovered particulates in excess of 100 microns diameter are recycled to the fast fluidized bed, the improvement comprising adding to the combustion zone a CO combustion promoter on a porous support having an average equivalent particle diameter of 100–400 microns and a surface area in excess of 20 $m^2/g$, and wherein the CO combustion promoter is present in an amount equal to 0.001–100 wt. ppm of a metal or metal compounds selected from the group of Pt, Pd, Rh, Os, Ir.

In yet another embodiment, the present invention provides a process for the circulating fluid bed combustion of coal in a fast fluidized bed comprising a sulfur acceptor material which reacts with sulfur oxides formed during coal combustion characterized by adding to the circulating fluid bed combustion unit a CO combustion promoter, in an amount equal to 0.001 to 100 wt. ppm, based on the weight of the circulating fluid bed, from the group of Pt, Pd, Ir, Rh, Os and compounds and mixtures thereof, disposed on a porous support having an average particle diameter of about 100–400 microns, a surface area in excess of 50 $m^2/g$, and operating with 100–105 percent of the air required by stoichiometry for complete combustion of the coal in the circulating fluidized bed combustion unit.

DETAILED DESCRIPTION

CIRCULATING FLUID BED COMBUSTORS

This is a mature, commercial process, with about 100 units in operation or under construction as of 1988. A detailed description thereof is not believed necessary. Further details may be taken from Circulating Fluidized Bed Technology II, previously discussed, which is incorporated herein by reference. Additional details of circulating fluidized bed combustors may also be taken from the U.S. patents incorporated by reference in the background discussion.

Figure 1:
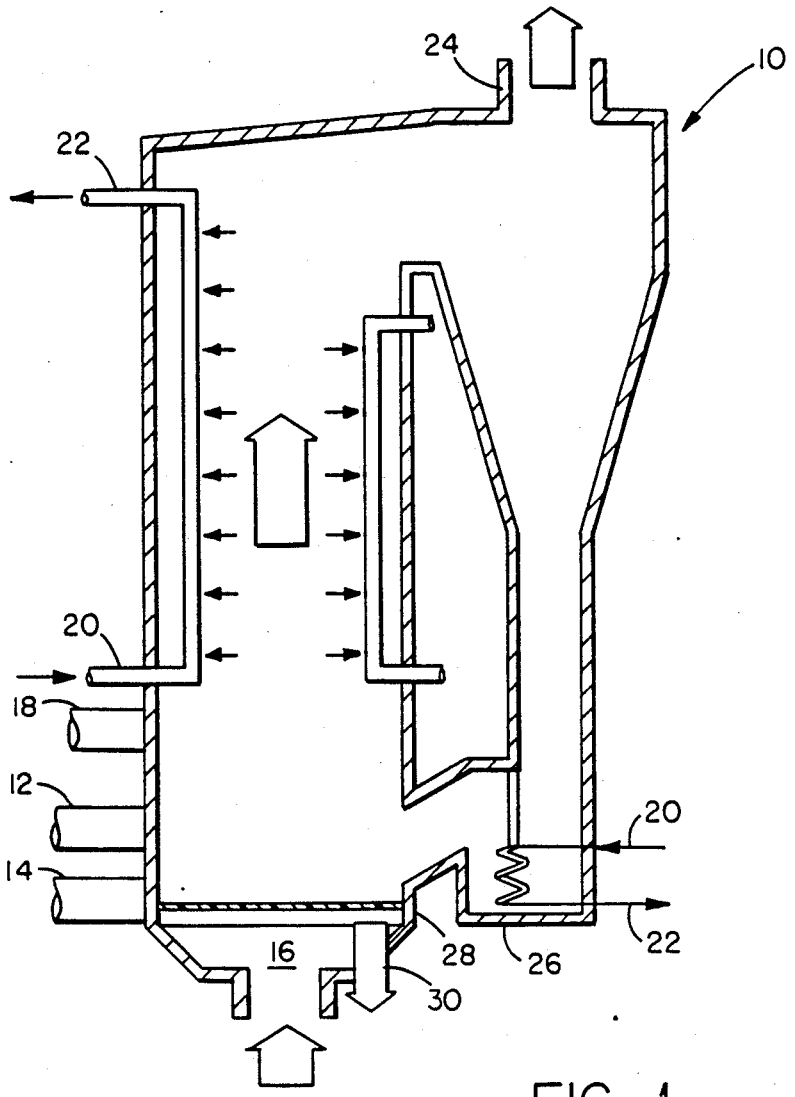
FIG. 1 (PRIOR ART)
FIG. 1 (Prior Art) is a simplified, schematic, cross-sectional view of a circulating fluid bed combustor.
Figure 2:
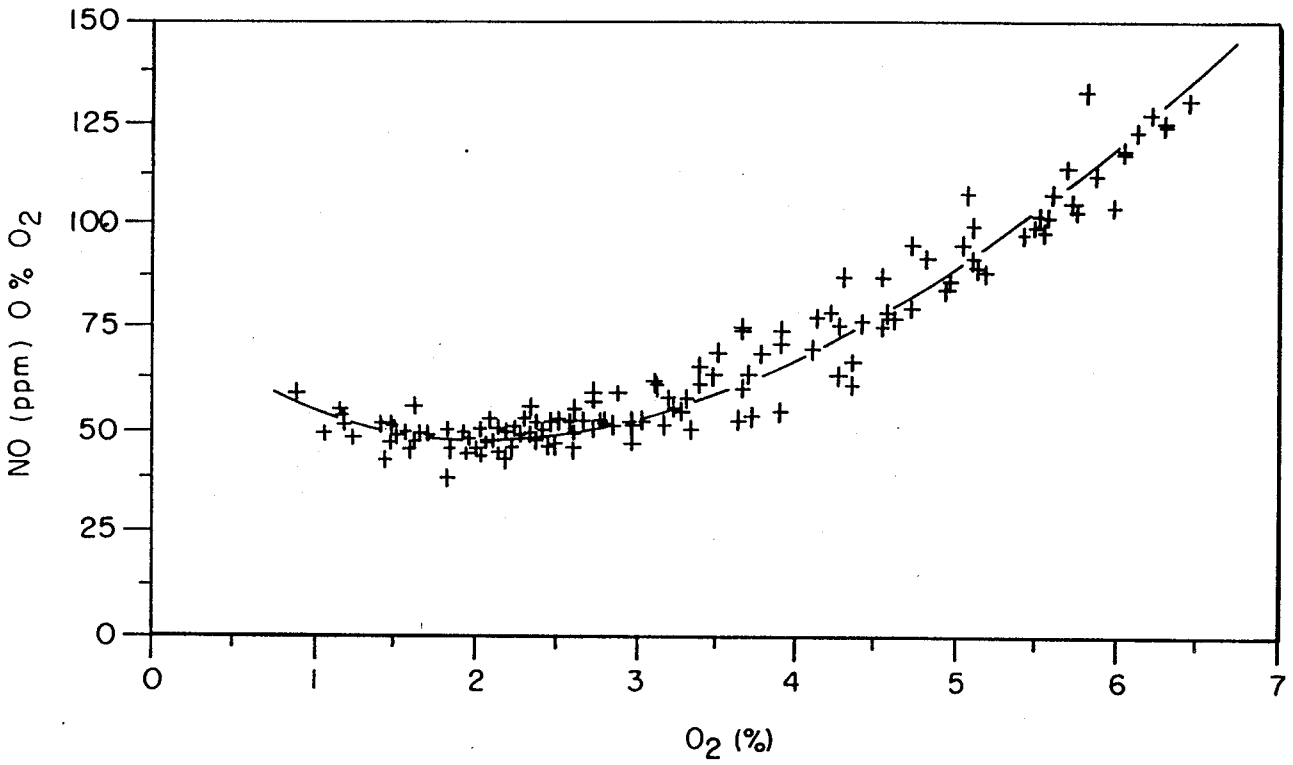
FIG. 2 illustrates how $NO_X$ emissions change with flue gas oxygen content in commercial CFB units.
Figure 3:
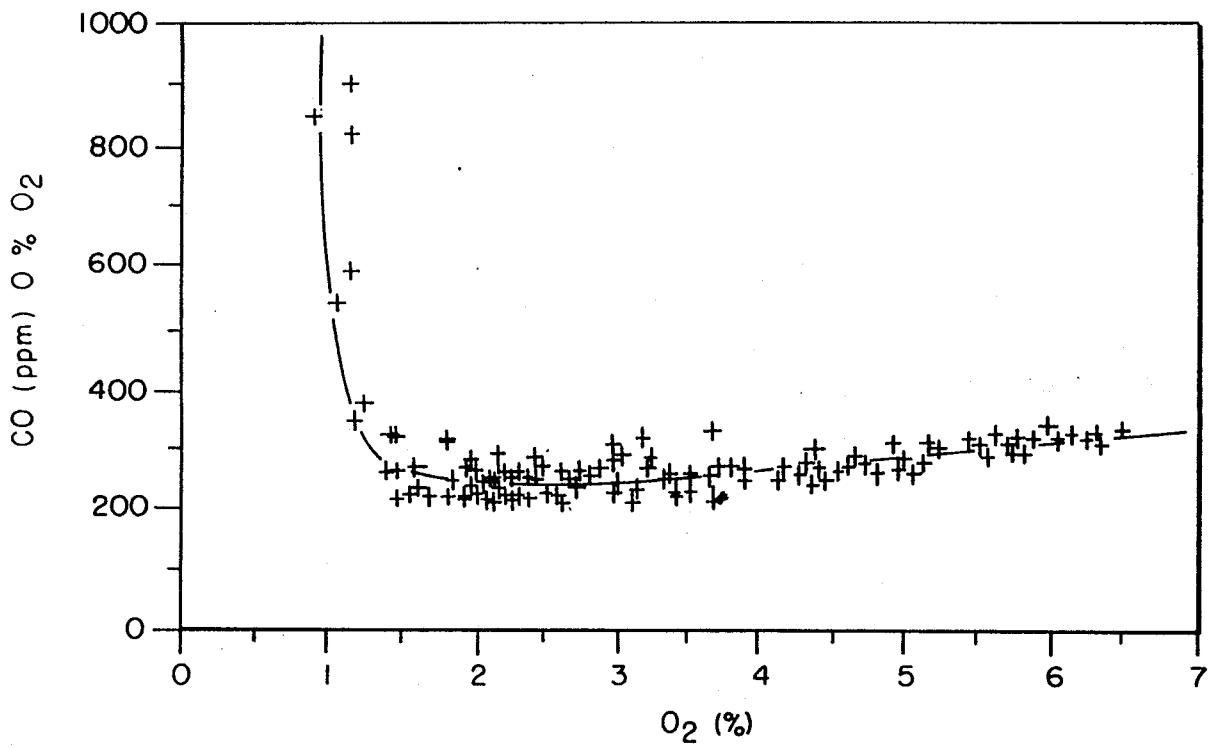
FIG. 3 shows how CO emissions change with flue gas $O_2$ content in commercial CFB units.

The typical circulating fluid-bed combustor illustrated in FIG. 1 shows a combustor 10 fed with a source of inert particles such as crushed limestone, through conduit 12 and fuel through conduit 14 together with a source of primary air through conduit 16 which ordinarily provides about 40–80% of the air required for combustion. A source of secondary air is fed through conduit 18 which provides the remaining 20–60% of the air necessary for combustion. Water circulating through heat exchangers 20, 20' is turned into steam when exiting conduits 22, 22' of heat exchangers 20, 20'. Gaseous products of combustion (flue gas) are removed through outlet 24 of combustor 10 with a recycle of the limestone and incompletely burned fuel occurring in conduit 26. Ash may be removed through grate 28 and through conduit 30 to a site remote from combustor 10. The fuel fed through conduit 14 may include hazardous wastes and sludges which are otherwise expensive to dispose of. The combustor can also burn coal, low-value petroleum coke, or other refinery products. For example, in refineries limited by fuel gas production, excess fuel gas, such as FCC fuel gas, can be burned in the CFB combustor in combination with other fuels.

CIRCULATING CO COMBUSTION PROMOTER

The CO combustion promoter contemplated for use herein is one which will readily circulate throughout the system, but will not be blown out with the fines. The promoter material should have an average particle size within the range of 80–400 microns, and preferably 100–300 microns, and most preferably 125–250 microns.

It is essential that the particles have physical properties which will allow them to be retained easily by the low efficiency cyclones associated with the CFB units. In most units this will mean that the terminal velocity of the promoter particles should be less than 15 feet per second, and preferably is about 4–12 feet per second.

Preferably, the CO combustion promoter is on a highly porous support. The support preferably has a porosity exceeding 50 percent. The particle density should be within the range of 1.4–2.4 g/cc, and preferably within the range of 1.5–2 g/cc. Many highly porous aluminas have particle densities of about 2 g/cc, and are ideal for use herein.

A majority, and preferably in excess of 90% of the CO combustion promoter is not on the outer surface of the promoter support. Conventional exchange/impregnation techniques will distribute the CO combustion promoter throughout the support particle.

The CO combustion promoter is preferably dispersed on a material having relatively high surface area, e.g. a surface area in excess of 20, and preferably above 50, or even in excess of 500 meters sq./g, and preferably having a surface area of 75–250 m sq./g.

Alumina is an ideal support for the CO combustion promoter, because of its porosity, density, and high surface area. All of these physical properties are essential to keep the platinum in a highly dispersed state, where it can promote rapid afterburning of carbon monoxide to carbon dioxide. Silica alumina, or silica Kaoline or other similar catalyst supports can be used.

By way of contrast, sand is not a good support for the platinum CO combustion promoter contemplated herein. Sand is not a porous material. The Pt is all on the surface, and too readily clogged by ash and/or erosion or abrasion losses. Sand's density is also somewhat higher than preferred, typically around 2.5 g/cc.

The amount of CO combustion promoter required can vary greatly, depending on the efficiency of its use within the unit, the temperature at which the unit operates, and the amount of combustion promoter metal which is occluded or covered up by slag, fly ash, etc.

Operation with an amount of CO combustion promoter equivalent in activity to 0.001–100 ppm platinum, based on the total weight of solids circulating in the CFB, is preferred. Because of the high temperatures at which CFB units operate, it will be possible in many instances to operate with significantly less platinum, e.g., 0.01–10 wt. ppm platinum (or an equivalent amount of other CO combustion promoting metal, i.e., 3–5 wt. ppm $O_S$ is roughly equivalent to 1 wt. ppm Pt) may be used herein. In many units operation with 0.1–5 ppm platinum equivalents will give very good results.

Operation with much greater amounts of CO combustion promoter is possible, e.g., equivalent to 100–500 ppm Pt, but is usually not necessary and adds to the cost of the process, so such operation is not preferred.

Any CO combustion promoters now used in fluidized catalytic cracking (FCC) units may be used herein. Pt, Pd, Ir, Rh, and Os may be used alone or in combinations. Some combinations, such as Pt/Rh, seem to reduce somewhat $NO_X$ emissions and may be preferred for use herein.

Although the same metals used to promote CO combustion in FCC units may be used in the process of the present invention, the conventional CO combustion promoter particles used in FCC are not suitable for use herein.

In typical FCC applications, the promoter material is present as platinum or some other CO combustion promoting metal, on a highly porous support, typically with an average particle size range of 40–80 microns. Typically the promoter contains 0.01, 0.1, or perhaps even 0.5 to 1 wt. % platinum. Typically the promoter contains 0.1 wt. % platinum.

If a drum of such CO combustion promoter were added to a CFB unit, all that would happen is that the promoter would be promptly swept out of the unit with the fly ash. The average particle size of the fly ash from most CFB units is about 75 microns. Some coals have 10–20 percent ash, so CFB units must efficiently remove particles below the size of the circulating dolomite, limestone, sand, etc., used to maintain a fluidized bed for heat exchange purposes. Ash is efficiently removed in CFB units by the use of low efficiency cyclones with exceedingly poor retention of particles less than 100–150 microns in diameter.

It will also be possible to create, in situ, in the CFB unit, promoter particles having the proper size. This will require addition of a soluble, readily decomposable CO combustion promoter metal precursor to the CFB unit. It will usually not be possible (as it is in FCC) to simply add some platinum compound to the feed. Adding chloroplatinic acid to the coal feed to the unit would lose most of the Pt to the fly ash produced by the rapid burning and disintegration of the coal. It is not preferred, for similar reasons, to add a CO combustion promoter solution to the combustion zone at the base of the fast fluidized bed where most of the combustion air is added. Again the promoter solution would be exposed too much to ash, and small particles of coal, and not enough of it would go on the circulating CO limestone, dolomite, sand, etc.

The preferred place for adding a platinum compound is to the regions of the CFB unit where natural elutriation has produced particles having the proper size. Several possibilities exist for this, namely injection of a CO combustion promoter metal solution into the upper, almost a dilute phase, region of the combustor, or into the cyclone dipleg, or into the dense bed heat exchanger region of the CFB.

Another alternative is to withdraw a slipstream of the circulating material, preferably at a location where the 100–300 micron size dolomite portion predominates, and impregnate or otherwise incorporate a CO combustion promoter into this slipstream of material and return the same to the circulating fluid bed.

AIR INJECTION

In order to minimize power consumption, and waste of low grade energy by heating up excess flue gas being discharged up the stack, it will be beneficial in many cases to closely monitor CO and/or $O_2$ concentrations of stack gas so that less than 10% excess air, more preferably less than 5% excess air is provided, and most preferably less than 2% excess air. Thus my process may operate with about an order of magnitude less excess air as compared to prior art CFB units.

Rather than cut down on air addition rates, the process of the present invention also allows significant increases in charge rate of combustible materials, without requiring additional air blower capacity, and/or an increase in the size of the CFB combustor. The only limitation would be the ability of heat exchange means to recover the greater amount of heat release associated with an increase in, e.g., coal charge rates to the CFB combustor.

STAGED AIR INJECTION

Preferably, one or more stages of air injection are supplied at various elevations within the CFB combustor. Staged air injection preferably provides 70–90 percent of the air required by stoichiometry in the densest region of the bed. The density of this region will vary somewhat from unit to unit, or in the same unit depending on throughput, material being burned, etc. In general terms, the highly expanded, fast fluidized bed of particulates has an average particle diameter in excess of about 200 microns. Typically this highly expanded bed will occupy from 10–40 percent of the vertical distance of the CFB combustor. Above this fast fluidized bed is a more dilute phase region.

Preferably enough air is added immediately downstream of the fast fluidized, expanded bed region to increase the total amount of oxygen present to 100–110 percent of that required by stoichiometry for complete combustion of CO to $CO_2$. Because of the excellent CO burning rates which can be achieved in the presence of the CO combustion promoter of the present invention, it is not necessary to operate with gross excesses of air such as has been done in the prior art.

EXAMPLE 1. (PRIOR ART)

The following example represents operating conditions in a circulating fluid bed boiler unit which was reported in the literature. The unit is a little unusual in that the feed was wood chips, rather than coal, so a sulfur capturing sorbent was not required to meet $SO_X$ emission limits. A solid particulate material was necessary for proper operation of the unit, so sand was added for heat transfer, proper bed fluidization, etc. Two CFB boiler designs are reported, a Babcock-Ultra Powered CFB boiler and an Energy Factors CFB boiler. Table 1, F. Belin, D. E. James, D. J. Walker, R. J. Warrick "Waste Wood Combustion in Circulating Fluidized Bed Boilers", reported in Circulating Fluidized Bed Technology, II at page 354.

TABLE I

Babcock & Wilcox CFB Boiler Performance Data

| | | Babcock-Ultrapower | | Energy Factors | |
|---|---|---|---|---|---|
| | Unit | Design | Test | Design | Test |
| Electric Load (Gross) | MW | 27.5 | 28.3 | 19.5 | 19.6 |

TABLE I-continued

| Babcock & Wilcox CFB Boiler Performance Data | | | | | |
|---|---|---|---|---|---|
| | | Babcock-Ultrapower | | Energy Factors | |
| | Unit | Design | Test | Design | Test |
| Max Steam Flow (MCR) | kg/s | 27.6 | 26.4 | 20.7 | 21.5 |
| | 1000 lb/hr | 218.6 | 209.0 | 164.0 | 170.8 |
| Steam Pressure | bar | 86.2 | 85.9 | 87.5 | 87.2 |
| | psig | 1250 | 1245 | 1270 | 1265 |
| Steam Temperature | °C. | 513 | 511 | 513 | 509 |
| | °F. | 955 | 951 | 955 | 949 |
| Feedwater Temperature | °C. | 147 | 151 | 186 | 196 |
| | °F. | 296 | 303 | 367 | 385 |
| Gas/Air Temperatures | | | | | |
| Furnace Exit Gas | °C. | 857 | 873 | 849 | 823 |
| | °F. | 1575 | 1603 | 1560 | 1514 |
| Flue Gas Leaving | °C. | 135 | 128 | 150 | 152 |
| Air Heater | °F. | 275 | 263 | 302 | 305 |
| Air Leaving Air | °C. | 209 | 203 | 191 | 189 |
| Heater | °F. | 408 | 398 | 375 | 372 |
| Thermal Efficiency (HHV Basis) | % | 78.8 | 79.81 | 81.3 | 81.28 |
| Fuel Moisture | % | 40.0 | 38.0 | 30.0 | 46.4 |
| Unburned Carbon Loss | % | 1.2 | .01 | 1.2 | 0.09 |
| Excess Air | % | 16 | 24 | 21 | 19 |
| Primary/Overfire | | | | | |
| Air Split | % | 50/50 | 50/50 | 60/40 | 25/75 |
| Emissions at MCR | | Limits: | | Limits: | |
| $NO_x$ | lb/$10^6$ Btu | 0.158 | .155 | .175 | 0.110 |
| CO | lb/$10^6$ Btu | 0.158 | .025 | .218 | 0.100 |

ILLUSTRATIVE EMBODIMENT (INVENTION)

In this example I have estimated the changes that would occur due to the addition of 1 ppm platinum to the circulating solids inventory in the Babcock-Ultrapower unit. I would add the platinum as a Pt on silica/alumina support having a particle density of about 2.0 g/cc and an average particle size of about 150 microns. The promoter would be similar to that used in conventional FCC catalyst, but quite a bit larger than catalyst used in FCC units, and somewhat heavier. Conventional spray drying is the preferred method of making the catalyst. The promoter would contain 0.1 wt. % platinum, so addition of 1 wt. % additive to the circulating inventory in the CFB would give 1 ppm platinum.

There will be a profound reduction in CO emissions. Although this is a beneficial result, it does not represent the best use of this technology.

I would prefer to reduce excess air, and/or increase fuel addition rate, up to the limit of the units heat exchanger capacity.

In designing a new unit, I would design and make the combustion zone, cyclones, and air blower smaller because of the reduction in air rates permitted by the invention. Operating with only 2% excess air, instead of 20% excess air would reduce the volume of the CFB unit by more than 10%, and reduce the capital cost by close to 10%, and the reduce energy consumption in the CFB by over 10%.

Use of a freely circulating CO combustion promoter would allow coke (or other fuel) combustion much higher up in the bed, without formation of excess $CO_2$ in the flue gas. The unit can thus burn much more feed, and generate more heat.

Circulating CO combustion promoter will not change the mechanical operation of the CFB. The heavy, relatively large fluidizable particles will be retained very well by the cyclones associated with the CFB unit.

I claim:

1. In a circulating fluidized bed combustion zone wherein a carbon-containing material is burned by contact with an oxygen-containing gas in a generally vertical combustor comprising a fast fluidized bed of particulates wherein at least a majority of the particulate matter in the fast fluidized bed has a particle diameter in excess of 100 microns, to generate a flue gas/particulate stream which is discharged from the top of the combustor, said flue gas comprising flue gas, fines having a particle diameter less than about 100 microns, and circulating particles having an average particle size of about 100–400 microns, which flue gas passes through a separation means to recover from the flue gas at least a majority of the 100–400 micron particles which are recycled to the circulating fluidized bed combustion zone, the improvement comprising adding to the circulating particles a circulating CO combustion promoter in an amount equal to 0.001 to 100 wt. ppm of a promoter selected from the group of Pt, Pd, Ir, Rh, Os and compounds and mixtures thereof.

2. The process of claim 1 wherein the CO combustion promoter is platinum, and is present in an amount equal to 0.01 to 50 wt. ppm.

3. The process of claim 1 wherein the amount of CO combustion promoter present is equivalent in CO oxidation activity to 0.05 to 10 wt. ppm Pt.

4. The process of claim 1 wherein the CO combustion promoter comprises Pt/Rh.

5. The process of claim 1 wherein the CO combustion promoter is impregnated on a porous support.

6. The process of claim 1 wherein the CO combustion promoter is on a support having an average equivalent particle diameter within the range of about 100–400 microns, an average particle density of 1.5–2.5 g/cc, and a surface area in excess of 20 $m^2/g$.

7. The process of claim 1 wherein the CO combustion promoter is on a support selected from the group of silica, alumina, silica/alumina.

8. The process of claim 1 wherein the CO combustion promoter support has an average equivalent particle diameter of 125–250 microns.

9. The process of claim 1 wherein the CO combustion promoter comprises a promoter metal or metal compound rich core within a promoter deficient shell.

10. The process of claim 1 wherein the CO combustion promoter is added as a liquid solution to the fast fluidized bed.

11. The process of claim 1 where the CO combustion promoter is added as a liquid solution to the circulating particles having an average particle size of about 100–400 at a location outside the combustor.

12. In a circulating fluidized bed combustion process wherein a carbonaceous material containing sulfur and nitrogen impurities is burned by contact with air in a generally vertical combustor comprising a fast fluidized bed of particulates, wherein at least a majority of the particulate matter in the fast fluidized bed has a particle diameter in excess of 100 microns, and at least 25 wt. % of the particulate matter in said bed comprises a sulfur accepting material, and wherein combustion of the carbonaceous material occurs in a lower portion of said fast fluidized bed to produce a dilute phase fluidized bed stream comprising carbon monoxide, carbon dioxide, $SO_X$ and $NO_X$ and particulates in excess of 100 microns in diameter comprising sulfur acceptor, and fines generated in said fast fluidized bed, wherein said dilute phase stream is passed to a separation means which recovers essentially all of the particulates in excess of 100 microns equivalent diameter and which discharges a majority of the fines with a flue gas stream, and said recovered particulates in excess of 100 microns diameter are recycled to the fast fluidized bed, the improvement comprising adding to the circulating particles a CO combustion promoter on a porous support having an average equivalent particle diameter of 100–400 microns and a surface area in excess of 20 $m^2/g$, and wherein the CO combustion promoter is present in an amount equal to 0.001–100 wt. ppm of a metal or metal compounds selected from the group of Pt, Pd, Rh, Os, Ir and wherein the CO combustion promoter circulates with the circulating particles.

13. The process of claim 12 wherein the CO combustion promoter comprises platinum, and is present in an amount equal to 0.01 to 50 wt. ppm.

14. The process of claim 12 wherein the CO combustion promoter support has an average equivalent particle diameter of 125–250 microns, an average particle density of 1.5–2.5 g/cc and a surface area in excess of 50 $m^2/g$.

15. The process of claim 12 wherein the CO combustion promoter is added as a liquid solution to the fast fluidized bed.

16. The process of claim 12 wherein the CO combustion promoter is added as a liquid solution to the circulating particles having an average particle size of about 100–400 at a location outside the combustor.

* * * * *